US007092667B1

(12) United States Patent
Landa et al.

(10) Patent No.: US 7,092,667 B1
(45) Date of Patent: Aug. 15, 2006

(54) FUSER AND INTERMEDIATE TRANSFER DRUMS

(75) Inventors: Benzion Landa, Nes-Ziona (IL); Amiran Lavon, Bat-Yam (IL); Avner Schneider, Nes-Ziona (IL); Ilan Romem, Ramat-Hasharon (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 47 days.

(21) Appl. No.: 10/399,024

(22) PCT Filed: Oct. 13, 2000

(86) PCT No.: PCT/IL00/00652

§ 371 (c)(1),
(2), (4) Date: Sep. 25, 2003

(87) PCT Pub. No.: WO02/31601

PCT Pub. Date: Apr. 18, 2002

(51) Int. Cl.
*G03G 15/20* (2006.01)

(52) U.S. Cl. ..... 399/330; 399/302; 399/308

(58) Field of Classification Search ..... 399/302, 399/308, 313, 307, 330, 331, 328, 333, 334; 492/4, 16–18, 46; 432/60; 219/216; 430/60
See application file for complete search history.

(56) References Cited

U.S. PATENT DOCUMENTS

| | | | |
|---|---|---|---|
| 3,574,912 | A | 4/1971 | Kraft |
| 4,091,264 | A | 5/1978 | Sarcia |
| 4,105,896 | A | 8/1978 | Schuster |
| 4,172,976 | A | 10/1979 | Namiki et al. |
| 4,229,644 | A | 10/1980 | Namiki et al. |
| 4,272,872 | A | 6/1981 | Hess et al. |
| 4,526,533 | A | 7/1985 | Pabst |
| 4,717,338 | A | 1/1988 | Cellier |
| 4,903,597 | A | 2/1990 | Hoage et al. |
| 4,945,387 | A | 7/1990 | Landa et al. |
| 5,028,964 | A | 7/1991 | Landa et al. |
| 5,047,808 | A | 9/1991 | Landa et al. |
| 5,089,856 | A | 2/1992 | Landa et al. |
| 5,157,238 | A | 10/1992 | Landa et al. |
| 5,286,948 | A | 2/1994 | Landa et al. |
| 5,335,054 | A | 8/1994 | Landa et al. |
| 5,426,495 | A | 6/1995 | Sawamura et al. |
| 5,497,222 | A | 3/1996 | Landa et al. |
| 5,554,476 | A | 9/1996 | Landa et al. |
| 5,592,269 | A | 1/1997 | Younes et al. |

(Continued)

FOREIGN PATENT DOCUMENTS

| | | |
|---|---|---|
| EP | 0 523 998 | 1/1993 |

(Continued)

OTHER PUBLICATIONS

Wakabayashi, N.; JP 08-320625; Dec. 3, 1996 & Patent Abstracts of Japan; vol. 097; No. 004; Apr. 30, 1997.

*Primary Examiner*—Hoang Ngo

(57) ABSTRACT

Apparatus for transferring visible images from a first surface to a second surface and/or for fusing or fixing a visible image to a substrate, comprising: a cylindrical member secured between two round end plates to form a cylindrical structure; a volatile liquid incorporated within the cylindrical structure in a cavity, at least one wall of which is thermally connected to the cylindrical member; and a heater that heats the liquid to an operating temperature, wherein the amount of the volatile liquid is such that all of the volatile liquid would be evaporated at a temperature that is less than about 20° C. above the operating temperature.

45 Claims, 4 Drawing Sheets

U.S. PATENT DOCUMENTS

| | | | | |
|---|---|---|---|---|
| 5,636,349 | A | 6/1997 | Landa et al. | |
| 5,689,767 | A | 11/1997 | Domoto et al. | |
| 5,984,848 | A | 11/1999 | Hyllberg et al. | |
| 6,584,294 | B1 * | 6/2003 | Landa et al. | 399/302 |

FOREIGN PATENT DOCUMENTS

| | | |
|---|---|---|
| EP | 0 704 773 | 4/1996 |
| EP | 0 772 100 | 5/1997 |
| EP | 0 775 948 | 5/1997 |
| JP | 54-056448 | 5/1979 |
| JP | 54-092750 | 7/1979 |
| JP | 62-056979 | 3/1987 |
| WO | WO 96/13760 | 5/1996 |
| WO | WO 96/17277 | 6/1996 |
| WO | WO 97/07433 | 2/1997 |
| WO | WO 99/61957 | 12/1999 |
| WO | WO 99/61958 | 12/1999 |
| WO | WO 00/31593 | 6/2000 |

* cited by examiner

FUSER AND INTERMEDIATE TRANSFER DRUMS

RELATED APPLICATIONS

The present application is a U.S. national application of PCT Application No. PCT/IL00/00652, filed on Oct. 13, 2000.

FIELD OF THE INVENTION

The present invention is related to the field of printers and copiers and more particularly to printers or copiers that utilize fusers, intermediate transfer members and/or elements that function as both fusers and intermediate transfer members.

BACKGROUND OF THE INVENTION

Printers and copiers are well known. Modern copiers that utilize powder or liquid toners comprising toner particles to form visible images generally form a latent electrostatic image on an image forming surface (such as a photoreceptor), develop the image utilizing a toner (such as the aforementioned powder or liquid toners) to form a developed image and transfer the developed image to a final substrate. The transfer may be direct, i.e., the image is transferred directly to the final substrate from the image forming surface, or indirect, i.e., the image is transferred to the final substrate via one or more intermediate transfer members.

In general, the image on the final substrate must be fused and fixed to the substrate. This step is achieved in most copiers and printers by heating the toner image on the substrate. In some copiers and printers the fusing and fixing of the image is performed simultaneously with the transfer of the image to the substrate. This is achieved by utilizing a heated intermediate transfer member to perform the transfer and by pressing the intermediate transfer member against the final substrate. This combination of heat and pressure softens the toner particles and fixes them to the substrate.

These processes and fixers, intermediate transfer members other components and liquid toners suitable for carrying them out and printers utilizing these structures and processes are described in detail in U.S. Pat. Nos. 4,945,387; 5,047,808; 5,028,964; 5,089,856; 5,157,238; 5,286,948; 5,335,054; 5,497,222; 5,554,476; and 5,636,349; and PCT patent publications WO 96/17277, WO 97/07433, WO 99/61957 and WO 99/61958, the disclosures of all of which are incorporated herein by reference.

Particular reference is made to U.S. Pat. Nos. 5,047,808; 5,554,476 and 5,636,349 which describe a number of attributes of preferred intermediate transfer members suitable for liquid toner imaging.

U.S. Pat. No. 5,047,808 describes an intermediate transfer member comprised of a rigid core and an overlying intermediate transfer blanket. As described in the patent, a preferred intermediate transfer member provides a first transfer of images from an image bearing surface to the intermediate transfer member and a second transfer of the images from the intermediate transfer member to the final substrate. While both first and second transfers are performed under pressure, second transfer (which includes fixing and fusing of the image to the substrate) is performed under much higher pressure than first transfer. The patent teaches that the deformation per unit pressure during first transfer should be much lower than during second transfer. In other words, the intermediate transfer member should be "harder" for second transfer.

U.S. Pat. No. 5,335,054 provides a particularly advantageous method of achieving this desired characteristic of the intermediate transfer member. This patent describes an intermediate transfer member having two types of layers which contribute to this effect. In particular, the preferred intermediate transfer member as described in this patent has a soft, thin conforming layer, preferably formed of a soft polymer, and a sponge layer underlying the soft conforming layer. These layers provide conformance of the intermediate transfer member with the surface of the image bearing surface at low pressure and relatively low deformation and the desired stiffness of the intermediate transfer member under higher pressure conditions. Advantageously, a plurality of sponge and/or conforming layers are used to provide greater control over the compressibility profile of the member at first and second transfer.

U.S. Pat. No. 5,636,349 describes another desirable characteristic of intermediate transfer members. As described in this patent, the intermediate transfer member should be heated to a temperature at which the image on it adheres to the substrate. While the member is still pressing against the substrate the member is cooled sufficiently such that the cohesion of the image increases to such an extent that the image cohesion forces are greater than those causing adhesion to the member. When these conditions are met, the image is transferred in its entirety from the intermediate transfer member to the final substrate without leaving any appreciable toner residue on the intermediate transfer member.

It can be appreciated that this combination of requirements (and other requirements which have not been mentioned above) places very tight limitations on intermediate transfer members. While intermediate transfer members as described in the prior art can meet these requirements, the transfer parameters must be tightly controlled and the operating window available for these processes is limited. In state of the art systems the required transfer temperatures are provided by heating the drum on which the blanket is mounted, such that the image transfer surface is heated to a required temperature of 90 to 110 degrees Celsius. Higher or lower temperatures are also useful, depending on the polymers used in the toner particles, the carrier liquid used and the speed of the printing process. Since the blanket needs a sponge layer to provide some of the compressibility requirements of the member, and since sponges generally have high thermal impedance, the back of the blanket is much hotter than its transfer surface, often as much as 60–70 degrees hotter.

Not only does the blanket generally have to meet the stringent operating requirements mentioned above, but must also do so under high temperature, often much higher than the temperatures required for the actual transfer process. Furthermore, it has been found that the sponge layer is susceptible to damage from paper misfeeds or jams. When a number of sheets are fed together or jams occur, the sponge is sometimes compressed past its recovery point.

Furthermore, it has been found that intermediate transfer members exhibit short term memory effects under certain conditions. These effects manifest themselves in slightly different transfer characteristics for areas which carried an image on a previous transfer from areas which did not (background areas). It is believed that the memory effect is caused by variations in surface temperature on the transfer surface and/or by uneven absorption of carrier liquid from the liquid toner by a surface transfer layer of the transfer member. PCT patent publication WO 96/13760 and U.S. Pat.

No. 5,592,269 provide at least partial solutions to these problems, at the cost of some additional system and/or toner complexity.

Reference is also made to U.S. Pat. No. 5,286,948, which describes a fusing apparatus and method utilizing a thin membrane as a fusing element. The membrane is mounted on two end elements to form a cylindrical drum of which the membrane forms the cylindrical surface. This element, which is generally too thin to support itself, especially during transfer, is supported by gas pressure within the drum and/or by mechanically applied pressure on the end elements to tension the membrane. It should be noted that the gas pressure itself also provides pressure on the end elements to tension the membrane.

PCT publication WO 00/31593, the disclosure of which is incorporated by reference, describes a roller, suitable for use as either a fuser or intermediate transfer member, in which a small amount of water or other liquid is placed in the interior of a roller formed by a thin membrane and two end plates. When the liquid is heated, the pressure in the roller caused by the evaporated liquid provides for a fuser suitable for fusing an image to a substrate and/or for an intermediate transfer drum.

EP 0 772 100 A2 describes a fuser roller in which vapor, evaporated from a heated liquid within a sealed roller, is used to heat the outer surface of the roller and fuse an image on a sheet against which the roller is pressed. The cylindrical surface of the roller is apparently rigid, since air is evacuated from the interior and the cylinder must be strong enough so that it doesn't collapse. Furthermore, the use of water as the liquid is not considered desirable, since the vapor pressure of water at the desired fusing temperature (190 degrees Celsius) is considered to be too high.

JP Publication 08320625 describes a fixing roller system in which the interior of a hollow roller is completely filled with water or oil. The liquid is heated and the roller is used as a fixing roller.

U.S. Pat. No. 4,172,976 describes heat rollers in which a relatively large amount of liquid having a relatively high vapor pressure, such as water or alcohol is contained. The liquid is heated via an intermediate conduction member situated between a heater at the center of the cylinder and the liquid.

The disclosures of the above referenced applications, patents and publications are incorporated herein by reference.

SUMMARY OF THE INVENTION

It is an object of some embodiments of the invention to provide an intermediate transfer member or fuser of modified design and performance.

In some embodiments of the invention, the intermediate transfer member or fuser comprises a thin membrane, as an image transfer and/or fusing element, that is mounted on two end elements to form a cylindrical drum, of which the membrane forms the cylindrical surface. The membrane, which may be too thin to support itself, especially during transfer, is supported by gas pressure within the drum and optionally by mechanically applied pressure on the end elements to tension the membrane. A gas pressure of about two to three atmospheres has been found to be suitable for supporting the membrane. Preferably, a relatively simple intermediate transfer blanket is mounted on the outside of the cylindrical surface.

One aspect of some preferred embodiments of the invention is concerned with the amount of filling of the drum by the liquid. In particular, according to this aspect of the invention, an interior chamber of the drum containing the liquid is mostly, but not completely filled with the liquid.

In the prior art device as described in the above referenced PCT publication WO 00/31593, the liquid provides a two-fold function. The first function is to heat the cylindrical outer surface so that the drum can be used for fusing. The second function is to support the cylindrical surface with enough pressure so that a relatively simple intermediate transfer blanket can be used for supporting images that are to be transferred when the drum is used as an intermediate transfer member. The resulting deformation characteristics of the cylindrical surface provides one element of the pressure/displacement characteristics of the intermediate member for optimum transfer of images to and from the member. However, in order to perform these functions, substantial amounts of vapor at high temperature and pressure are present in the drum. This may cause a hazard if the drum fails.

In accordance with an exemplary embodiment of the invention, the section of the drum just interior of the outer surface is almost filled with liquid. However, a small empty space is provided, for example of the order of a few tens to about 150 cc of volume, which is not filled by the liquid. If too little unfilled volume is provided, the desired give of the outer surface will be reduced or eliminated.

It is appreciated that almost filling the space with liquid does increase the amount of liquid that has to be heated and hence increases the warm-up time of the roller. In accordance with some embodiments of the invention the total amount of liquid is reduced by constructing the roller with an inner cylinder which is not filled with the liquid, such that only the volume between the inner cylinder and the outer cylinder is filled with liquid. In an exemplary embodiment of the invention, only 30% or less of the volume of the total volume of the drum is filled with liquid, although over 80, 90, 95 or 98% of the outer section of the drum is filled with liquid.

In an exemplary embodiment of the invention, the inner cylinder is of quartz or another radiation transparent material. Thus, if a halogen lamp or other radiation source is placed inside the inner cylinder, the outer cylinder is directly heated by the radiation. Preferably, the liquid covers the inner cylinder completely. It has been found that if the inner cylinder is not completely covered, the initial (standby) temperature of the upper portion of the outer cylinder (i.e., the portion outside the liquid) is 20–30 degrees Celsius higher than the lower portions. This difference is not critical, since during operation (and rotation of the drum), the liquid comes in contact with all portions of the outer cylinder such that the temperature quickly equalizes.

Alternatively, the inner cylinder may be constructed such that it absorbs or is otherwise heated by the radiation from the heater and transmits it, by conduction, to the liquid.

According to some embodiments of the invention, the liquid is water or propylene glycol, which when it evaporates provides the desired pressure in the cylinder.

Alternatively, only a small amount of volatile liquid is used and oil is used for the remaining liquid. The amount of volatile liquid may be small enough so that all, or almost all of it evaporates at the operating temperature. As described below, this avoids the possibility of substantial over-pressure if the temperature rises and resulting problems if the drum fails mechanically.

In accordance with another aspect of some embodiments of the invention, the amount of liquid in a cavity below the outer cylinder is limited, such that at the operating temperature, the liquid is completely or almost completely in vapor form. Thus, while the volume of pressurized vapor may be large, the pressure rise is limited by the lack of a large source of liquid. This volume can be reduced substantially by providing an inner cylinder as aforesaid. Furthermore, the heat capacitance of the liquid is low, such that warm-up is very fast.

In embodiments of the invention in which a small amount of liquid remains during operation, the liquid may transfer heat to the image during fusing, causing condensation of the liquid.

In some embodiments of the invention which incorporate this aspect, a small amount of oil or mercury may be added to the water. In these embodiments, most or all of the water is evaporated to provide the pressure in the cylinder and the oil or mercury, which is not evaporated, equalizes the temperature of the cylinder along its length. This combination of a small amount of water and a small amount of oil provides for limitation on the pressure rise and a limitation on the amount of vaporizable material that can be emitted if the cylinder fails, while achieving the heat uniformity of the cylinder surface which results when some liquid remains. The low amounts of liquids that have to be heated results in a fast warm-up time.

An aspect of some embodiments of the invention involves the use of a combination of a volatile liquid such as water or some other volatile liquid and a non-volatile liquid such as oil. Some of the embodiments of the invention that incorporate this aspect are described above and some are described with respect to the following aspect.

An aspect of the invention, applicable when most or all of the volatile liquid is evaporated (or when none is used), is the uniformization of the temperature along the length of the cylinder.

In an embodiment of the invention, small metal balls or other small particles (formed for example of aluminum, copper or brass) are provided in the portion of the cylinder that is in thermal contact with the outer surface. These balls contact the cylinder and transfer heat to and from it. These balls (as well as the following embodiments) may be used in conjunction with pressure support using an evaporated liquid or may be used without such a liquid.

In some embodiments of the invention, oil or mercury is present in the cylinder together with the balls. These materials increase the thermal contact between the balls and the inner surface of the cylinder. Alternatively, mercury may be used without the balls to provide the same function. The use of balls with the mercury may reduce the amount of mercury needed.

It should also be noted that when materials are dissolved in the water, the vapor pressure is reduced. Thus, where a higher temperature is desired for a particular pressure, a suitable amount of material is added to the water to reduce the pressure. Alternatively or additionally a mixture of liquids may be used to control the viscosity of the liquid and/or the vapor pressure.

In some embodiment of the invention, the portion of the drum not containing a liquid at room temperature, contains air at at least one atmosphere. This filling with air is desirable to avoid collapse of the drum when it is cooled. A one way valve may be provided such that the pressure in the drum never falls below the outside pressure.

As used herein, the term "most of the volatile liquid is evaporated" or similar terms, means that the amount of liquid that remains would all evaporate were the temperature raised by 20° C. above the operating temperature of the liquid, under the conditions of use. As used herein, the volatility (or substantial non-volatility) of the of the liquid is determined at the operating temperature, namely between about 90–160° C.

There is thus provided, in accordance with an exemplary embodiment of the invention, an intermediate transfer apparatus for transferring visible images from a first surface to a second surface or a fuser apparatus for fusing and fixing toner images on a substrate, comprising:

- a cylindrical member secured between two round end plates to form a cylindrical structure;
- a volatile liquid incorporated within the cylindrical structure in a cavity, at least one wall of which is thermally connected to the cylindrical member; and
- a heater that heats the liquid to an operating temperature, wherein the amount of the volatile liquid is such that all of the volatile liquid would be evaporated at a temperature that is less than about 20° C. above the operating temperature.

In various exemplary embodiments of the invention all of the volatile liquid would be evaporated at a temperature that is less than about 10° C. or 5° C. above the operating temperature.

Optionally, all of the volatile liquid is evaporated at the operating temperature.

Optionally, the cavity also contains a quantity of a liquid that is substantially non-volatile at the operating temperature. In exemplary embodiments, the non-volatile liquid is less than 5% or 10% of the volume of the cavity.

In some embodiments of the invention, the non-volatile liquid is mercury or an oil.

Some embodiments of the invention include heat conducting particles, such as metal particles within the cavity. The particles may have a diameter of between about 50 and 250 micrometers, optionally, between about 100 and 200 micrometers.

In some embodiments of the invention, the total amount of liquid is such that it fills between 80% and 98% of the volume of the cavity, optionally, over about 90%, 95% or 98% or more of the volume.

In some embodiments of the invention, the portion of the cavity volume not filled by liquid at the operating temperature is less than 20, 30, 50, 100, 150 cubic centimeters.

In some embodiments of the invention, the non-volatile liquid comprises an oil.

In some embodiments of the invention, the volatile liquid comprises water. Optionally, the liquid includes including an additive added to the liquid to control the evaporation of the volatile liquid to provide a given pressure of between 2–4 atmospheres in the cavity at the operating temperature. Alternatively or additionally, the volatile liquid comprises propylene glycol.

There is further provided, in accordance with a preferred embodiment of the invention, an intermediate transfer apparatus for transferring visible images from a first surface to a second surface or fuser apparatus for fusing and fixing toner images on a substrate comprising:

- a cylindrical member secured between two round end plates to form a cylindrical structure;
- a liquid incorporated within the cylindrical structure in a cavity, a wall of which contacts the cylindrical member; and
- a heater that heats the liquid to an operating temperature, wherein the amount of the liquid is such that it fills between 80% and 98% of the volume of the cavity.

In some embodiments of the invention, the liquid comprises a volatile liquid. Optionally the liquid includes an additive added to the liquid to control the evaporation of the volatile liquid to provide a given pressure of between 2–4 atmospheres in the cavity at the operating temperature. In some embodiments the volatile liquid comprises propylene glycol. Alternatively or additionally, the volatile liquid comprises water.

In some embodiments of the invention, the amount of the volatile liquid is such that all of the volatile liquid would be evaporated at a temperature that is less than about 5° C., 10° C. or 20° C. above the operating temperature. In some embodiments all of the volatile is evaporated at the operating temperature.

In various embodiments of the invention, the liquid fills over about 90%, 95% or 98% or more of the volume.

In various embodiments the portion of the cavity volume not filled by liquid at the operating temperature is less than 20, 30, 50, 100 or 150 cubic centimeters.

There is further provided, in accordance with a preferred embodiment of the invention, an intermediate transfer apparatus for transferring visible images from a first surface to a second surface or a fuser for fixing and fusing a toner image to a substrate, comprising:

a cylindrical member secured between two round end plates to form a cylindrical structure;

a liquid incorporated within the cylindrical structure in a cavity, a wall of which contacts the cylindrical member; and a heater that heats the liquid to an operating temperature, wherein the liquid is a mixture of volatile and non-volatile components.

In some embodiments of the invention, the non-volatile liquid comprises an oil. Alternatively or additionally, the non-volatile component comprises mercury.

In some embodiments of the invention, the volatile liquid comprises water. Optionally the liquid includes an additive added to the liquid to control the evaporation of the volatile liquid to provide a given pressure of between 2–4 atmospheres in the cavity at the operating temperature. Alternatively or additionally, the volatile liquid comprises propylene glycol.

Optionally, the volatile components comprise between 1% to 60% by weight of the total amount of liquid.

In various embodiments of the invention, the heater heats the liquid to a temperature between about 110° C. and about 140° C., optionally between about 115 degrees Celsius and about 135 degrees Celsius or between about 120 degrees Celsius and about 130 degrees Celsius. Optionally, the heater is a radiant heater situated substantially centered within the cylindrical structure.

In some preferred embodiments of the invention, the apparatus includes a second cylindrical member interior of the cylindrical member. Optionally, the cavity is the volume enclosed by the cylindrical member, the second cylindrical member and the end plates. In various embodiments of the invention, the cavity has a volume that is less than 30% of the volume enclosed by the cylindrical member and the end plates.

Optionally, the cylindrical member forms a seal at the end plates and said cylindrical surface is supported by gas pressure internal to the cylindrical structure. In various embodiments of the invention, the gas pressure is equal to between about 2 and about 4 atmospheres. Optionally, the gas pressure comprises vapor pressure of the volatile liquid. Optionally, the portion of the cavity not filled by liquid at room temperature is filled with air.

Optionally, the gas pressure comprises air pressure.

Optionally, the apparatus includes a one way valve which allows gas to pass from the exterior of the cylindrical structure to the cavity.

Optionally, the apparatus includes a transfer surface on an external cylindrical surface of the cylindrical structure. Optionally, the transfer surface is comprised in a transfer blanket attached to the cylindrical member.

In various embodiments of the invention, the cylindrical member is a membrane having a thickness of less than or equal to about 250 micrometers, optionally, greater than about 50 or 125 micrometers. The membrane may have a thickness of between 100 and 200 micrometers.

Optionally, the cylindrical member is comprised of nickel.

There is further provided, in accordance with a preferred embodiment of the invention, an intermediate transfer apparatus for transferring visible images from a first surface to a second surface or a fuser for fusing and fixing a toner image to a substrate, comprising:

a cylindrical member secured between two round end plates to form a cylindrical structure; and heat conducting particles incorporated within the cylindrical structure in a cavity, at least one wall of which is thermally connected to the cylindrical member.

The apparatus includes a liquid to improve heat transfer between the cylindrical member and the particles.

Optionally, the particles are metal particles.

In various embodiments of the invention, the particles have a diameter of between about 50 and 250 micrometers, or between about 100 and 200 micrometers.

Optionally, the liquid comprises an oil and/or mercury.

There is further provided, in accordance with an embodiment of the invention, printing apparatus comprising:

an image forming surface on which a visible image is formed; and an intermediate transfer member according to the invention, which receives the image from the image forming surface and transfers it to another surface.

Optionally, the visible image is a toner image, such as a liquid toner or powder toner image.

BRIEF DESCRIPTION OF THE DRAWINGS

Exemplary embodiments of the invention are described in the following sections with reference to the drawings. The figures are generally not to scale and the same or similar reference numbers are used for the same or related features on different drawings.

DETAILED DESCRIPTION OF EXEMPLARY EMBODIMENTS

Figure 1A:
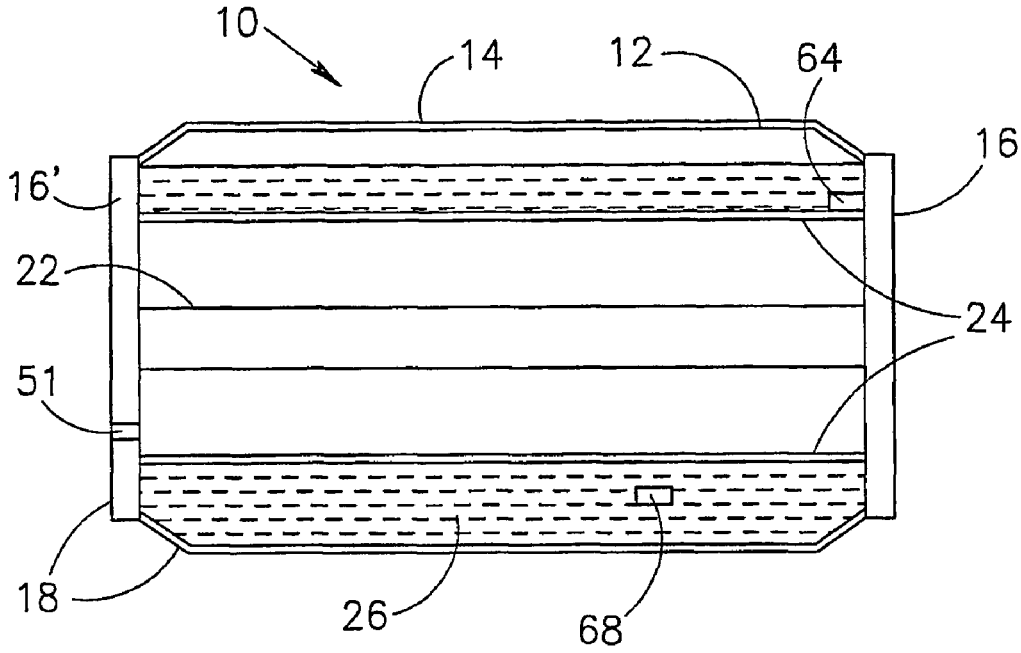
FIGS. 1A and 1B schematically show respective longitudinal and trans-axial cross-sectional illustrations of an intermediate transfer member, in accordance with an exemplary embodiment of the present invention.
Figure 1B:
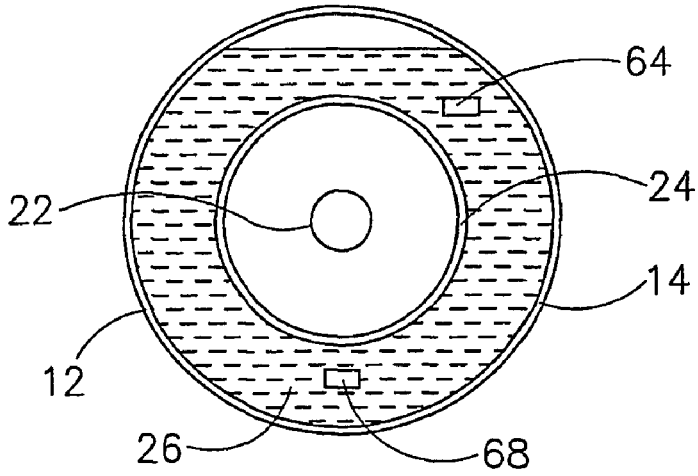

Reference is now made to FIGS. 1A and 1B which respectively show longitudinal and trans-axial cross-sectional illustrations of an intermediate transfer member 10, in accordance with an exemplary embodiment of the present invention. Intermediate transfer member 10, as shown, comprises:

a) A cylindrical drum 18, comprising a membrane 12 of about 50 to about 250 micrometers thickness, typically about 125 micrometers, to which an intermediate transfer blanket 14 is mounted or adhered. The membrane may be made of a metal. The membrane is shown as having a bend near its ends. However, the membrane may be formed as a simple cylinder.

b) Intermediate transfer blanket 14 (or optionally a suitable multi-layer coating on drum 18). In some embodiments of the invention, no blanket is used, although it is usually desirable to provide at least a non-stick coating on the membrane.

c) Two end plates, 16 and 16', on which membrane 12 is mounted and attached, by soldering, welding or gluing to form cylindrical drum 18. The membrane is attached to and forms a seal with the end plates. The attachment may be by welding or other suitable means.

d) a heating element 22, optionally part of an axial element 20, such as described as element 50 in PCT publication WO 00/31593, mounted substantially on the center of end plates 16 and 16'. Alternatively to the use of an internal heating element, the intermediate transfer member may be heated by an external radiant source or by passing an electric current through the thin membrane. Other heating methods, described in PCT publication WO 00/31593 or as known in the art may also be used.

e) An optional inner cylindrical element 24 surrounding heating element 22. Element 24 is optionally made of quartz or other material that transmits radiation that is generated by element 24, which radiation directly heats membrane 12. Alternatively or additionally, element 24 is heated by heating element 22 and heats a liquid 26 between cylinder 24 and membrane 12 by conduction. Attachment of the conducting cylinder to the end plates may be by welding or the like and a quartz cylinder may be sealed utilizing o-rings between its ends and the end plates. Alternatively, the inner cylinder may have its own end sealing mechanism.

The diameter of membrane 12 and of element 24 may be varied to suit the design requirements of the particular system. In an exemplary embodiment, the diameter of element 24 is about 145 mm, the diameter of membrane 12 is about 170 mm, such that only about 27% of the total volume enclosed by membrane 12 is situated between the membrane and element 24. The temperatures at standby and during operation may vary to suit the particular operating conditions of the toner utilized in the imaging system. In an exemplary embodiment, at standby, both the membrane surface and the surface of the blanket are about 135° C., with only a few degrees difference between them. During operation, due to heat transfer to other elements of the system, the blanket surface temperature is reduced to about 100° C. The pressure is generally between 2 and 4 atmospheres. All of these values will vary depending on the type of toner used and/or the process speed of the printer.

Membrane drum 12, which may be too thin to support itself, especially during transfer, is preferably supported by gas pressure within the drum and optionally additionally by mechanically applied internal pressure on end plates 16 and 16', by axial element 20, to transfer the membrane for image transfer, preferably, transfer of liquid toner images. A gas pressure of about two to three atmospheres has been found suitable for supporting the membrane and providing a desired resilience.

Intermediate transfer blanket 14, is preferably of relatively simple structure. This structure is described in detail with respect to FIG. 3, which is the same as FIG. 3 of PCT publication WO 00/31593. The detail of this element is provided herein for completeness.

In order to efficiently transfer an image to and from an optional release layer, (see element 114 of FIG. 3 of PCT publication WO 00/31593) which is comprised in intermediate transfer blanket 14, membrane drum 12, is desirably maintained at a suitable temperature. It is undesirable for there to be substantial axial temperature variations.

In the embodiment shown in FIG. 1, liquid 26 fills almost all of the volume between inner cylindrical element 24 and membrane 12. However, a small empty space is provided, for example of the order of a few tens to about 150 cc of volume, which is not filled by the liquid. The volume between cylinder 26 and membrane 12 may be filled to 80, 90, 95, 98 or even greater percentage. Lower percentage fillings may also be useful, in some embodiments of the invention.

In one embodiment of the invention, the liquid is water. In another embodiment of the invention, the liquid is propylene glycol. A mixture of the liquids (or of other volatile liquids) may be used to provide a desired pressure at a desired temperature. Alternatively or additionally, materials dissolved in the liquid may be used to adjust the temperature/pressure values to the desired values.

In another embodiment of the invention, the liquid is a mixture of liquids and only a small proportion of the liquid is volatile. The rest of the liquid is a non-volatile liquid such as oil. The amount of the volatile liquid is preferably limited to the amount that will vaporize at the desired temperature of to an amount that is somewhat higher than this amount. This assures that the desired pressure will be achieved at the desired temperature and that the pressure does not build up to an excessive level in case the intermediate member overheats. Extreme over-pressure could cause the integrity of the device to fail resulting, possibly, in an explosion. The rest of the liquid is present to assure that the temperature on different portions of the drum is equalized during operation.

Figure 2A:
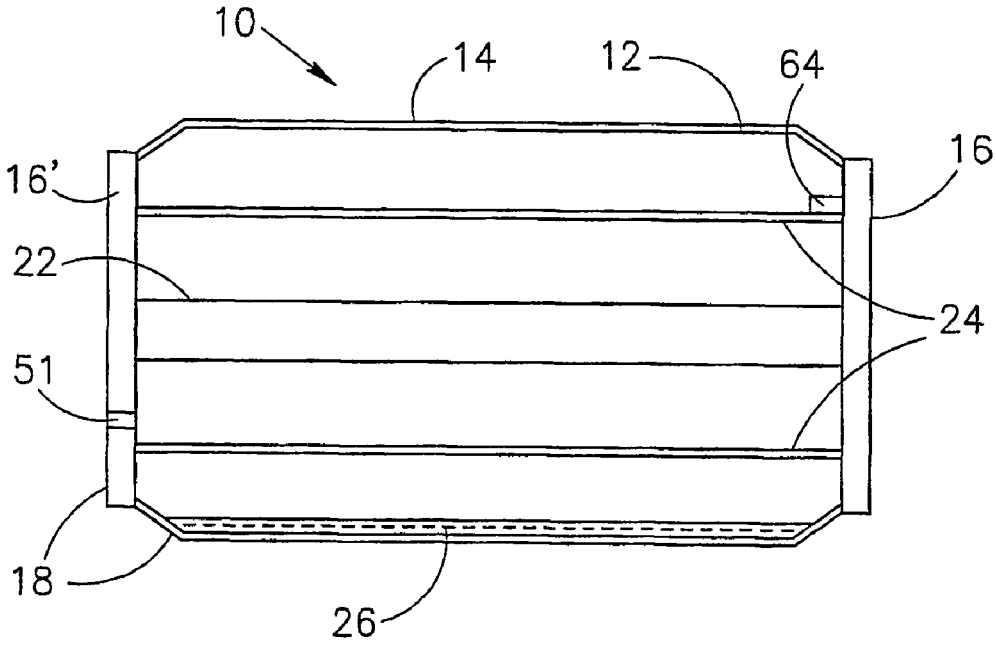
FIGS. 2A and 2B schematically show respective longitudinal and trans-axial cross-sectional illustrations of an alternative intermediate transfer member, in accordance with an exemplary embodiment of the present invention.
Figure 2B:
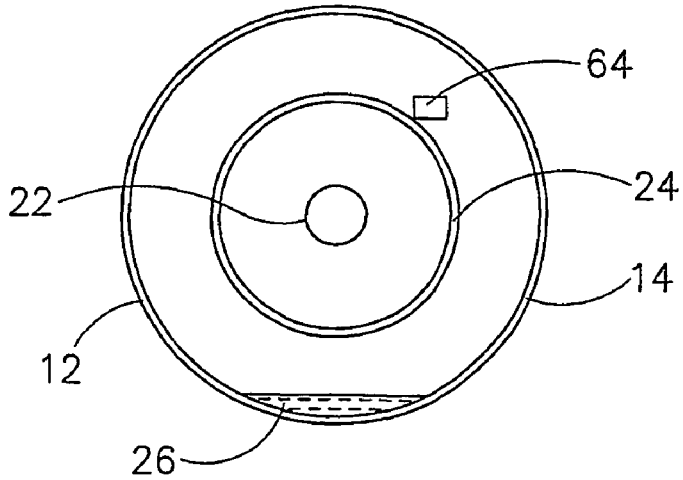

A second embodiment of the invention is shown schematically in FIGS. 2A and 2B. In this embodiment, the amount of liquid is very low, such that only a small portion (for example, less than 15%, 20%, 25% or even none) of the liquid is present in liquid form during operation. In one embodiment a small amount of liquid remains as a result of condensation of some of the vapors as they heat membrane 12. However, it should be understood that even if only a small amount of liquid is present at the operating temperature, the amount of possible over-pressure will be substantially limited.

Alternatively or additionally, a small amount of oil, mercury or other non-volatile (at the operating temperature) liquid may be mixed with the volatile liquid. All or most of the volatile liquid may be vaporized as aforesaid, with the oil providing equalization of the temperature along the length of the membrane.

Alternatively or additionally to the inclusion of a non-volatile liquid, the volatile liquid may be mixed with small balls or particles of a metal. The metal particles provide for equalized heat transfer to and from the membrane. The presence of at least a small amount of liquid water and/or non-volatile liquid at operating temperatures improves the heat transfer between the particles and the membrane. In exemplary embodiments of the invention the particles have a diameter of between 50 and 250 micrometers, for instance about 100, 150 or 200 micrometers.

Most embodiments of the invention are also useful when a thick cylinder is used instead of the membrane. Under these circumstances, no support of the membrane is required and, in general, the pressure interior to the membrane is not critical. It should be understood, however, that the simplification of the blanket, as described in PCT publication WO 00/31593, may not be possible when the outer surface of the drum is too rigid, since it is the flexibility of the membrane that apparently functionally replaces the sponge layer in more complex blankets.

In some embodiments of the present invention, a pressure sensor 64 and/or a temperature sensor 68, are positioned respectively on an end plate's inside surface and in the liquid in order to measure and control both liquid temperature and gas pressure inside drum 1S.

For water systems a one way valve, shown symbolically as 51 on FIG. 1, is preferably used, to assure that the drum does not collapse when cooled. Valve 51 allows for outside air to enter the drum whenever the outside pressure is greater than the inside pressure. This results, effectively, in at least one atmosphere of air pressure in the drum at all times. Alternatively or additionally, the space is sealed and filled with air at one atmosphere at room temperature. This feature is applicable to the embodiments of FIG. 1 and FIG. 2.

In some embodiments of the invention, regions 58 of axial part 20, (see FIG. 2A of PCT publication WO 00/31593), comprise springs which may be loaded, to apply mechanical pressure to end plates 46 and 46', in order to prevent the drum from collapsing when there is no heat. Alternatively or additionally, an additional axial structure may be provided to provide pressure on the plates. In this case, if cylindrical 24 is also used, expansion means are provided at the juncture of the end plates and element 24 to allow for expansion of the overall length of the drum without breaking the seal between element 24 and the end plates.

Figure 3:
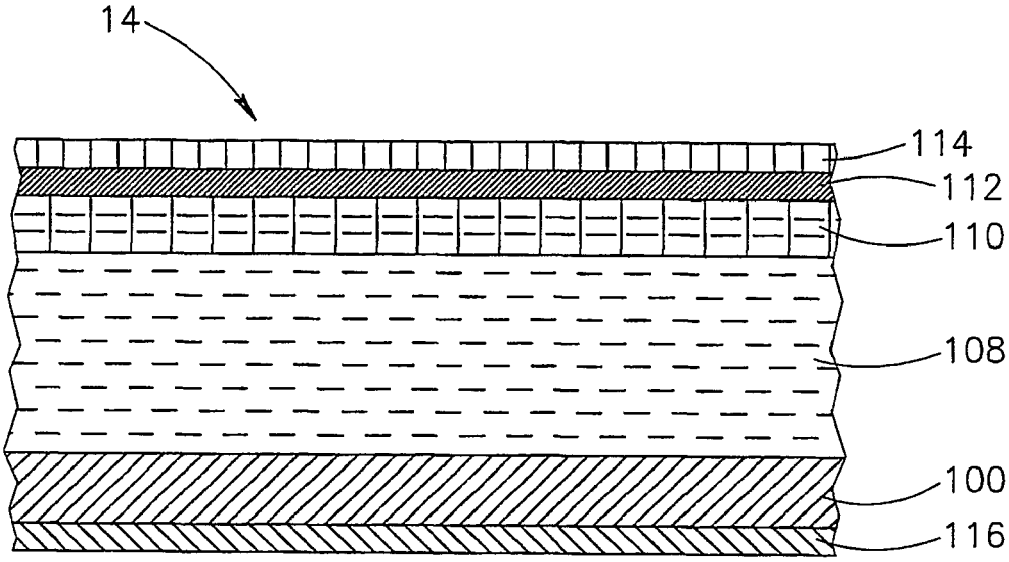
FIG. 3 is a schematic cross sectional illustration of an image transfer blanket, in accordance with an embodiment of the invention.

Reference is now made to FIG. 3 which is a schematic cross sectional illustration of an example of a low mass intermediate transfer member blanket 14, in accordance with an exemplary embodiment of the invention. Blanket 14, may be formed on a polyester fabric 100 about 110 microns thick, which has been impregnated with a layer of acrylic rubber (HyTemp 4051 EP, Zeon Chemicals), made conductive by loading it with 20 parts of conductive carbon black (XE-2, Degussa) for each 100 parts of rubber together with curing agent (sodium stearate) and accelerator (NPC 50 of Zeon) as specified by the manufacturer. The conductive acrylic rubber is dissolved in toluene, to about 17% solids, and coated onto the fabric so impregnation results. The total thickness of fabric 100, after impregnation, is about 120 microns. It was found that by impregnating the fabric with a conductive material voltage could be passed through the entire thickness of the ITM, obviating the need for a metal clamp.

A soft acrylic rubber film (HyTemp 4051EP, Zeon Chemicals), 108, of about 400 microns thickness, which is loaded with about 20 parts by weight of carbon black (Black Pearls 130, Cabot Corp.) together with curing agent and accelerator as specified by the manufacturer and produced by a calendering technique, is laminated using heat and pressure to the conductive-layer impregnated fabric. The soft acrylic rubber layer, 108, which has a hardness of about 30 shore A, partially replaces the function of the sponge layer in the standard ITM, and allows transfer to difficult substrates such as rough paper.

An additional acrylic rubber layer, 110, (HyTemp 4051 EP, Zeon Chemicals), filled with 40 parts carbon black (Black Pearls 130, Cabot Corp.) to 100 parts of rubber together with curing agent and accelerator as specified by the manufacturer, and yielding a hardness of about 45 shore A, is preferably solution coated on soft acrylic rubber layer 108, yielding a dry film of about 20 microns thickness. This thin, harder film 110 lowers the stickiness of the blanket.

Acrylic rubber layer, 110, is coated by a thin coat of primer, 112, for example, (3-glycidoxypropyl) trimethoxysilane of ABCR, Germany. Primer layer, 112, is then dried by a fan to obtain a dry coating of about 1 micron.

The primer layer is preferably coated by a release layer. A preferred release layer 114, is prepared according to the following procedure: RTV 11 and RTV 41, of General Electric, are separately dissolved in hexane and Isopar-L (Exxon), and centrifuged in order to remove the filler. The liquid is decanted off, to be concentrated by evaporation to a concentration of about 70% and undissolved solids are discarded. 60 parts by weight of concentrated and defillered RTV 11 (based on the dissolved solids) are mixed with 40 parts by weight of concentrated and defillered RTV 41 (based on the dissolved solids), and 1 part by weight of carbon black (Ketjenblack 600, Akzo) is added to the mixture. The mixture of RTV 11, RTV 41 and carbon black is diluted with Isopar-L to about 50% solid monomers. For each 5 gm of solids in the mixture 20%, by weight, of oleic acid (JT Baker), 10%, by weight, of ethyl silicate (Chordip) and 200 microliters of dibutyl tin dilaurate (Aldrich) are added to the solution. After letting the release solution stand at room temperature for about one hour, the release solution is coated onto the blanket layer 112, to obtain a dry film thickness of about 5 microns.

Blanket 14, is then held at room temperature for about 2 hours before a final cure of 3 hours at 110° C. After this last cure, an adhesive layer, 116, is applied to the uncoated side of polyester fabric 100. After having been thus coated, adhesive 116 is dried at 60° C. for about 30 minutes and then cured for about 15 minutes at 110° C. The final thickness of adhesive 116 is about 30 microns. An adhesive 116 may be prepared by mixing 2% by weight of benzoyl peroxide (based on the solids) with Q2-7735 silicone pressure sensitive adhesive (Dow Corning).

While the above materials and dimensions represent the best mode of producing a blanket for carrying out the invention, it should be understood that wide variations on the materials and dimensions are possible and that completely different constructions are possible, depending, inter alia on the type of toner used. Furthermore, while the above blanket is suitable for liquid toners, powder toners may advantageously use a different construction, suitable for the mechanisms used for first and second transfer of such toners. The use of such a blanket is optional in the practice of many embodiments of the invention. Other blankets (or no blanket at all) are possible options.

With the sponge layer removed, a thinner, much less expensive blanket may be used. The blanket above described has a much lower thermal resistance. As a consequence, the drum itself needs to be heated to a much lower temperature compared to the temperature required in the prior art. In particular, it has been found that a temperature differential as small as 20 to 30 degrees Celsius is sufficient to efficiently transfer an image using the above described transfer blanket. This lower temperature requirement allows for low temperature adhesives and other components of the blanket and for higher reliability of the blanket. Eliminating the sponge layer eliminates failure of the blanket from paper jams, which is one of the leading causes of blanket failure in prior art transfer blankets.

A transfer blanket such as described above has a shorter nip, compared to prior art transfer blankets (3 mm versus 6+ mm) which have a sponge layer in their structure. A shorter nip appears to improve small dot transfer capability of the blanket. It reduces thermal shock occurrence by providing greater thermal uniformity across the transfer blanket and lowers the electrical current for a given transfer voltage value at the blanket's release layer resulting in higher voltage uniformity over different portions of release layer 114. Transfer blanket 14, is especially suitable for good first transfer of an electrostatic image to an intermediate transfer member. And, as has been noted, transfer blanket 14 is also suitable for transfer and fusing of the image from intermediate transfer member 48 onto a final substrate, such as paper, preferably by heat and pressure.

Figure 4:
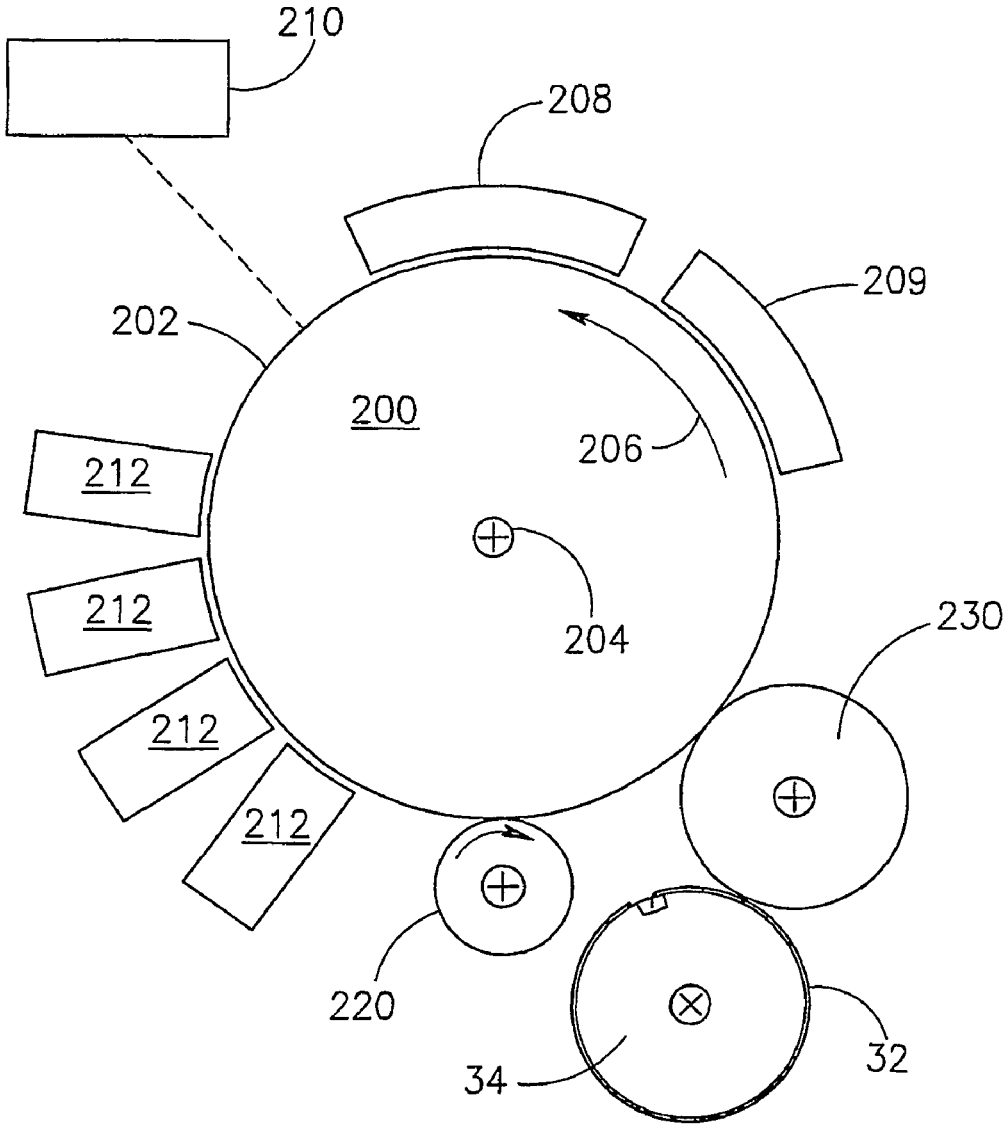
FIG. 4 is a schematic illustration of an imaging system, in accordance with an embodiment of the invention.

The above described preferred embodiments of the present invention, of intermediate transfer member and blanket may be efficiently utilized in an imaging apparatus such as the apparatus schematically illustrated in FIG. 4. For convenience, the apparatus of FIG. 4 is very simplified and does not include many of the details required in such apparatus, since the intermediate transfer member of the invention is useful for a wide variety of existing printers and copiers and since these existing devices need little in the way of substantive redesign. For details of some systems for which the invention is useful, the reader is referred to the documents incorporated herein by reference. It should be noted that the description which follows is presented in the context of an electrophotographic system employing a liquid toner, however, the invention is useful in powder toner systems as well.

The apparatus of FIG. 4 comprises a photoreceptor drum 200, which has a photoconductive surface 202, rotating on a shaft 204. Drum 200 is driven in the direction of arrow 206 such that photoconductive surface 202 moves past a corona discharge device 208 adapted to charge surface 202. An image to be reproduced is focused by a scanner 210 upon surface 202. The areas of surface 202 struck by light conduct the charge, or a portion thereof, to ground, thus forming an electrostatic latent image on surface 202.

A set of developing stations 212 selectively develop the latent image on surface 202 to form a developed image. Preferably, latent image corresponding to one printed color in the final image is successively formed and developed by one of developers 212 to form a single color (separation) image. Alternatively, a single developing station, in which the liquid toner is changed, depending on the desired image color.

Excess liquid is removed from the developed image by metering apparatus which may incorporate a squeegee roller 220.

Transfer of the image to a carrier sheet 32, such as paper, supported on a roller 34, is effected by an intermediate transfer member 230, as described above in detail with respect to FIGS. 1–3. After transfer of the image, any residual toner on surface 202 is removed at cleaning station 209.

In some embodiments of the present invention, especially when the liquid is heated by a heating element immersed in it, the drum, intermediate transfer member, carrier sheet and roller are optionally arranged so as to have the carrier sheet brought in contact with the intermediate transfer member at between 6 and 9 o'clock as shown. This arrangement enables maximum heating and temperature equalization of the intermediate transfer member at second transfer and a certain amount of cooling of the member prior to first transfer.

In the claims of the present application the verbs, "comprise" and "include" and conjugates thereof "mean including but not necessarily limited to."

While the invention has been described with reference to certain preferred embodiments, various modifications, for example, the use of powder toner, will be readily apparent to and may be readily accomplished by persons skilled in the art without departing from the spirit and the scope of the above teachings. Furthermore, while the present invention has been described in the context of an intermediate transfer member, it should be understood that many aspects of the invention are equally applicable to fusers. Therefore, it is understood that the invention may be practiced other than as specifically described herein without departing from the scope of the following claims:

What is claimed is:

1. Apparatus for transferring visible images from a first surface to a second surface and/or for fusing or fixing a visible image to a substrate, comprising:

a cylindrical member secured between two round end plates to form a cylindrical structure;

a volatile liquid incorporated within the cylindrical structure in a cavity, at least one wall of which is thermally connected to the cylindrical member; and a heater that heats the liquid to an operating temperature, wherein the amount of the volatile liquid is such that all of the volatile liquid would be evaporated at a temperature that is less than about 20° C. above the operating temperature.

2. Apparatus according to claim 1 wherein all of the volatile liquid would be evaporated at a temperature that is less than about 10° C. above the operating temperature.

3. Apparatus according to claim 2 wherein all of the volatile liquid would be evaporated at a temperature that is less than about 5° C. above the operating temperature.

4. Apparatus according to claim 1 wherein all of the volatile liquid is evaporated at the operating temperature.

5. Apparatus according to claim 1 wherein the cavity also contains a quantity of a liquid that is substantially non-volatile at the operating temperature.

6. Apparatus according to claim 5 wherein the volume of the non-volatile liquid is less than 10% of the volume of the cavity.

7. Apparatus according to claim 6 wherein the volume of the non-volatile liquid is less than 5% of the volume of the cavity.

8. Apparatus according to claim 5 wherein the non-volatile liquid is mercury.

9. Apparatus according to claim 5 wherein the non-volatile liquid is an oil.

10. Apparatus according to claim 5 wherein the total amount of liquid is such that it fills between 80% and 98% of the volume of the cavity.

11. Apparatus according to claim 10 wherein the portion of the cavity volume not filled by liquid at the operating temperature is less than 150 cubic centimeters.

12. Apparatus according to claim 11 wherein the portion of the cavity volume not filled by liquid at the operating temperature is less than about 50 cubic centimeters.

13. Apparatus according to claim 12 wherein the portion of the cavity volume not filled by liquid at the operating temperature is less than about 20 cubic centimeters.

14. Apparatus according to claim 5 wherein the liquid fills over about 90% of the volume.

15. Apparatus according to claim 14 wherein the liquid fills over about 95% of the volume.

16. Apparatus according to claim 1 and including heat conducting particles within the cavity.

17. Apparatus according to claim 16 wherein the heat conducting particles are metal particles.

18. Apparatus according to claim 1 wherein the volatile liquid comprises water.

19. Apparatus according to claim 18 and including an additive added to the liquid to control the evaporation of the volatile liquid to provide a given pressure of between 2–4 atmospheres in the cavity at the operating temperature.

20. Apparatus according to claim 1 wherein the volatile liquid comprises propylene glycol.

21. Apparatus according to claim 1 wherein the wall of the cylindrical structure contacts the cylindrical member.

22. Apparatus according to claim 1 wherein the heater heats the liquid to a temperature between about 110° C. and about 140° C.

23. Apparatus according to claim 22 wherein the heater heats the liquid to a temperature between about 115 degrees Celsius and about 135 degrees Celsius.

24. Apparatus according to claim 23 wherein the heater heats the liquid to a temperature between about 120 degrees Celsius and about 130 degrees Celsius.

25. Apparatus according to claim 1 wherein the heater is a radiant heater situated substantially centered within the cylindrical structure.

26. Apparatus according to claim 1 and including a second cylindrical member interior of the cylindrical member.

27. Apparatus according to claim 26 wherein the cavity is the volume enclosed by the cylindrical member, the second cylindrical member and the end plates.

28. Apparatus according to claim 27 wherein the cavity has a volume that is less than 30% of the volume enclosed by the cylindrical member and the end plates.

29. Apparatus according to claim 1 wherein the cylindrical member forms a seal at the end plates and wherein said cylindrical surface is supported by gas pressure internal to the cylindrical structure.

30. Apparatus according to claim 29 wherein the gas pressure is equal to between about 2 and about 4 atmospheres.

31. Apparatus according to claim 29 wherein the gas pressure comprises vapor pressure of the volatile liquid.

32. Apparatus according to claim 1 wherein the portion of the cavity not filled by liquid at room temperature is filled with air.

33. Apparatus according to claim 1 wherein the pressure within the gas pressure comprises air pressure.

34. Apparatus according to claim 1 and including a one way valve which allows gas to pass from the exterior of the cylindrical structure to the cavity.

35. Apparatus according to claim 1 and including a transfer surface on an external cylindrical surface of the cylindrical structure.

36. Apparatus according to claim 35 wherein the transfer surface is comprised in a transfer blanket attached to the cylindrical member.

37. Apparatus according to claim 1 wherein the cylindrical member is a membrane having a thickness of less than or equal to about 250 micrometers.

38. Apparatus according to claim 37 wherein the thickness is greater than about 50 micrometers.

39. Apparatus according to claim 38 wherein the thickness of the membrane is between 100 and 200 micrometers.

40. Apparatus according to claim 37 wherein the thickness of the membrane is about 125 micrometers or greater.

41. Apparatus according to claim 1 wherein the cylindrical member is comprised of nickel.

42. Printing apparatus comprising:

an image forming surface on which a visible image is formed; and an intermediate transfer member according to claim 1 which receives the image from the image forming surface and transfers it to another surface.

43. Printing apparatus according to claim 42 wherein the visible image is a toner image.

44. Printing apparatus according to claim 43 wherein the toner image is a liquid toner image.

45. Printing apparatus according to claim 43 wherein the toner image is a powder toner image.

* * * * *